US012134742B2

(12) United States Patent
Colucci et al.

(10) Patent No.: US 12,134,742 B2
(45) Date of Patent: Nov. 5, 2024

(54) FUEL COMPOSITION

(71) Applicant: Afton Chemical Corporation, Richmond, VA (US)

(72) Inventors: William Jay Colucci, Midlothian, VA (US); John Mengwasser, Cypress, TX (US)

(73) Assignee: Afton Chemical Corporation, Richmond, VA (US)

( * ) Notice: Subject to any disclaimer, the term of this patent is extended or adjusted under 35 U.S.C. 154(b) by 62 days.

(21) Appl. No.: 17/937,069

(22) Filed: Sep. 30, 2022

(65) Prior Publication Data

US 2024/0132791 A1 Apr. 25, 2024

(51) Int. Cl.

| | |
|---|---|
| ***C10L 1/222*** | (2006.01) |
| ***C10L 1/16*** | (2006.01) |
| ***C10L 1/2383*** | (2006.01) |
| ***C10L 10/18*** | (2006.01) |

(52) U.S. Cl.

CPC ..... *C10L 1/2222* (2013.01); *C10L 1/1616* (2013.01); *C10L 1/2383* (2013.01); *C10L 10/18* (2013.01); *C10L 2200/0423* (2013.01); *C10L 2230/22* (2013.01); *C10L 2270/023* (2013.01)

(58) Field of Classification Search

CPC .... C10L 1/2222; C10L 1/1616; C10L 1/2383; C10L 10/18; C10L 2200/0423; C10L 2230/22; C10L 2270/023

See application file for complete search history.

(56) References Cited

U.S. PATENT DOCUMENTS

| | | | |
|---|---|---|---|
| 2,129,264 | A | 9/1938 | Baxter et al. |
| 2,425,755 | A | 8/1947 | Roberts et al. |
| 2,425,845 | A | 8/1947 | Toussaint et al. |
| 2,448,664 | A | 9/1948 | Fife et al. |

(Continued)

FOREIGN PATENT DOCUMENTS

| | | | |
|---|---|---|---|
| CA | 2089833 | A1 | 8/1993 |
| CN | 1256302 | A | 6/2000 |

(Continued)

OTHER PUBLICATIONS

Smith, S. Scott et al. Measurement and Control of Fuel Injector Deposits in Direct Injection Gasoline Vehicles. SAE International; Oct. 14, 2013. doi:10.4271/2013-01-2616.

(Continued)

*Primary Examiner* — Ellen M McAvoy

(74) *Attorney, Agent, or Firm* — Honigman LLP

(57) ABSTRACT

A detergent additive package comprising a quaternary ammonium internal salt detergent and a Mannich base detergent mixture, wherein the quaternary ammonium internal salt is obtained from amines or polyamines that is substantially devoid of any free anion species, wherein the Mannich base detergent mixture comprises a first Mannich base detergent component derived from a di- or polyamine and a second Mannich base detergent component derived from a monoamine, wherein the weight ratio of the first Mannich base detergent to the second Mannich base detergent mixture ranges from about 1:6 to about 3:1, and wherein the weight ratio of the quaternary ammonium internal salt detergent and the Mannich base detergent mixture ranges from about 1:10 to about 1:100.

17 Claims, 1 Drawing Sheet

(56) References Cited

U.S. PATENT DOCUMENTS 2,457,139 A 12/1948 Fife et al.
2,475,755 A 7/1949 Pearson
2,568,876 A 9/1951 White et al.
2,886,423 A 5/1959 Kozikowski
3,015,668 A 1/1962 Kozikowski
3,027,246 A 3/1962 Bartlett
3,092,474 A 6/1963 Ebner
3,172,892 A 3/1965 Le Suer et al.
3,198,613 A 8/1965 Udelhofen
3,202,678 A 8/1965 Stuart et al.
3,216,936 A 11/1965 Le Suer et al.
3,219,666 A 11/1965 Norman et al.
3,254,025 A 5/1966 Le Suer
3,272,746 A 9/1966 Le Suer et al.
3,361,673 A 1/1968 Le Suer et al.
3,468,640 A 9/1969 Barusch et al.
3,676,089 A 7/1972 Morris et al.
3,778,371 A 12/1973 Malec
4,038,043 A * 7/1977 Garth ..... C10L 1/2383 44/424
4,056,531 A 11/1977 Malec
4,067,698 A 1/1978 Steckel
4,152,499 A 5/1979 Boerzel et al.
4,171,959 A 10/1979 Vartanian
4,231,759 A 11/1980 Udelhofen et al.
4,234,435 A 11/1980 Meinhardt et al.
4,248,719 A 2/1981 Chafetz et al.
4,253,980 A 3/1981 Hammond et al.
4,326,973 A 4/1982 Hammond et al.
4,338,206 A 7/1982 Hammond et al.
4,482,357 A 11/1984 Hanlon
4,605,808 A 8/1986 Samson et al.
4,613,341 A 9/1986 Zaweski et al.
4,729,769 A 3/1988 Schlicht et al.
4,787,916 A 11/1988 Feldman
4,844,714 A 7/1989 Vogel et al.
4,877,416 A 10/1989 Campbell et al.
5,024,677 A 6/1991 Wang
5,250,174 A 10/1993 Hart
5,254,138 A 10/1993 Kurek
5,330,667 A 7/1994 Tiffany, III
5,393,309 A 2/1995 Cherpeck
5,514,190 A 5/1996 Cunningham et al.
5,518,511 A 5/1996 Russel et al.
5,575,823 A 11/1996 Wallace et al.
5,620,486 A 4/1997 Cherpeck
5,634,951 A 6/1997 Colucci et al.
5,697,988 A 12/1997 Malfer et al.
5,725,612 A 3/1998 Malfer et al.
5,752,989 A 5/1998 Henly et al.
5,756,428 A 5/1998 Emert et al.
5,800,103 A 9/1998 Stadtfeld et al.
5,814,111 A 9/1998 Graham et al.
5,873,917 A 2/1999 Daly
5,876,468 A 3/1999 Moreton
6,048,373 A 4/2000 Malfer et al.
6,166,238 A 12/2000 Filipkowski
6,405,711 B1 6/2002 Smith et al.
6,458,172 B1 10/2002 Macduff et al.
6,462,014 B1 10/2002 Johnson
6,475,250 B2 11/2002 Krull et al.
6,548,458 B2 4/2003 Loper
6,695,890 B1 2/2004 Hazel et al.
6,730,773 B2 5/2004 Heinen
6,800,103 B2 10/2004 Malfer et al.
6,867,171 B2 3/2005 Harrison et al.
7,297,675 B2 11/2007 Alef
7,402,185 B2 7/2008 Aradi et al.
7,435,272 B2 10/2008 Aradi et al.
7,704,289 B2 4/2010 Alters et al.
7,744,660 B2 6/2010 Burrington et al.
7,766,982 B2 8/2010 Colucci et al.
7,906,470 B2 3/2011 Stevenson et al.
7,947,093 B2 5/2011 Barton et al.
7,951,211 B2 5/2011 Barton et al.
8,097,570 B2 1/2012 Boitout et al.
8,231,695 B2 7/2012 Cunningham et al.
8,425,627 B2 4/2013 Dietz et al.
8,449,630 B2 5/2013 Lange et al.
8,475,541 B2 7/2013 Fang et al.
8,486,876 B2 7/2013 Brewer et al.
8,496,716 B2 7/2013 Lange et al.
8,557,003 B2 10/2013 Malfer et al.
8,778,034 B2 7/2014 Cunningham
8,863,700 B2 10/2014 Fang et al.
8,894,726 B2 11/2014 Fang et al.
8,961,623 B2 2/2015 Stevenson et al.
8,974,551 B1 3/2015 Fang et al.
9,062,265 B2 6/2015 Reid et al.
9,340,742 B1 5/2016 Fang et al.
10,308,888 B1 * 6/2019 Schwab ..... C10L 1/224
10,457,884 B2 * 10/2019 Russo ..... C10L 1/2383
2003/0014910 A1 1/2003 Aradi et al.
2003/0131527 A1 7/2003 Colucci et al.
2004/0029766 A1 2/2004 Frick et al.
2004/0060226 A1 4/2004 Bongart et al.
2004/0167040 A1 8/2004 Dahlmann et al.
2005/0066572 A1 3/2005 Colucci et al.
2005/0085676 A1 * 4/2005 Panchalingam ..... C10L 1/23 585/15
2005/0120619 A1 6/2005 Koch
2005/0215411 A1 9/2005 Mackney et al.
2006/0070293 A1 4/2006 Lange et al.
2006/0168876 A1 8/2006 Colucci et al.
2006/0196110 A1 9/2006 Schwahn et al.
2006/0196111 A1 9/2006 Colucci et al.
2006/0272597 A1 12/2006 Burrington et al.
2007/0015681 A1 1/2007 Allef et al.
2007/0193119 A1 8/2007 Schwab
2007/0245621 A1 10/2007 Malfter et al.
2008/0086936 A1 4/2008 Cunningham et al.
2008/0113890 A1 5/2008 Moreton et al.
2008/0307698 A1 12/2008 Barton et al.
2009/0049740 A1 2/2009 Hurst
2009/0071065 A1 3/2009 Malfer et al.
2009/0235576 A1 9/2009 Volkel et al.
2009/0282731 A1 11/2009 Malfer et al.
2010/0005706 A1 1/2010 Burgazli et al.
2010/0024289 A1 2/2010 Smith
2010/0037513 A1 2/2010 Petrucci et al.
2010/0037514 A1 2/2010 Malfter et al.
2010/0132253 A1 6/2010 Kaufman et al.
2010/0151396 A1 6/2010 Papachristos et al.
2010/0236510 A1 9/2010 Shea et al.
2011/0162263 A1 7/2011 Vilardo et al.
2011/0185626 A1 8/2011 Barton et al.
2011/0237469 A1 9/2011 Khandekar et al.
2011/0258917 A1 10/2011 Garcia et al.
2011/0302828 A1 12/2011 Fang et al.
2011/0308550 A1 12/2011 Reid
2011/0315107 A1 12/2011 Grabarse et al.
2012/0010112 A1 1/2012 Grabarse et al.
2012/0291339 A1 11/2012 Martin et al.
2013/0031827 A1 2/2013 Reid et al.
2013/0031828 A1 2/2013 Reid et al.
2013/0104826 A1 5/2013 Burgess et al.
2013/0220255 A1 8/2013 Fang
2013/0233267 A1 9/2013 Barbour
2013/0237466 A1 9/2013 Lange et al.
2013/0247450 A1 9/2013 Wolf
2013/0255139 A1 10/2013 Dolmazon et al.
2013/0296210 A1 11/2013 Hansch et al.
2013/0298948 A1 11/2013 Company et al.
2013/0312318 A1 11/2013 Peretolchin et al.
2013/0227878 A1 12/2013 Wolf et al.
2013/0324665 A1 12/2013 Shaikh et al.
2013/0333650 A1 12/2013 Fang et al.
2014/0157655 A1 6/2014 Tort et al.
2014/0174390 A1 6/2014 Reid et al.
2014/0196678 A1 7/2014 Fang et al.
2015/0033617 A1 2/2015 Arondel et al.
2015/0252277 A1 9/2015 Hansch et al.
2016/0272912 A1 9/2016 Voelkel et al.
2016/0289584 A1 10/2016 Russo et al.

(56) References Cited

U.S. PATENT DOCUMENTS

| | | | | |
|---|---|---|---|---|
| 2020/0024536 | A1 | 1/2020 | Shanahan et al. | |
| 2021/0155863 | A1* | 5/2021 | Galante-Fox | F02M 63/0265 |
| 2022/0325195 | A1* | 10/2022 | Galante-Fox | C10L 1/2222 |
| 2023/0203391 | A1* | 6/2023 | Sanson | C10L 1/22 44/422 |
| 2023/0203394 | A1* | 6/2023 | Schwab | C10L 10/04 44/422 |

FOREIGN PATENT DOCUMENTS

| | | | |
|---|---|---|---|
| CN | 101671584 | B | 5/2013 |
| EP | 0016312 | A1 | 10/1980 |
| EP | 0293192 | A1 | 11/1988 |
| EP | 1293553 | A2 | 3/2003 |
| EP | 1411105 | A2 | 4/2004 |
| EP | 1518918 | A1 | 3/2005 |
| EP | 1918355 | A1 | 5/2008 |
| EP | 2033945 | A1 | 3/2009 |
| EP | 2674471 | A1 | 12/2013 |
| EP | 2987845 | A1 | 2/2016 |
| GB | 842728 | A1 | 7/1960 |
| GB | 2493377 | A | 2/2013 |
| WO | 2004050806 | A2 | 6/2004 |
| WO | 2005023965 | A1 | 3/2005 |
| WO | 2010132209 | A1 | 11/2010 |
| WO | 2013000738 | A2 | 1/2013 |
| WO | 2013017889 | A1 | 2/2013 |
| WO | 2013070503 | A1 | 5/2013 |
| WO | 2013092533 | A1 | 6/2013 |
| WO | 2015011505 | A1 | 1/2015 |
| WO | 2017168312 | A1 | 10/2017 |

OTHER PUBLICATIONS

The extended European Search Report issued in Application No. 23198788.4 on Jan. 29, 2024, 7 pages.

* cited by examiner

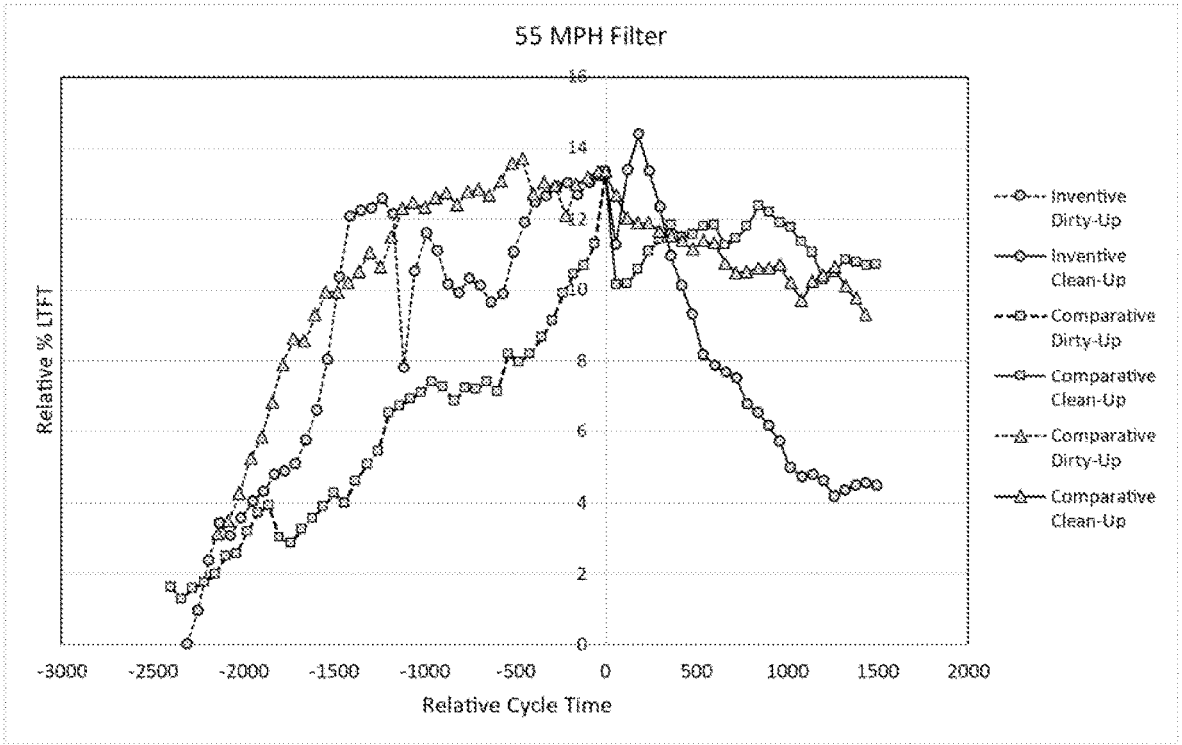
55 MPH Filter
Relative % LTFT
Relative Cycle Time
16
14
12
10
8
6
4
2
0
-3000
-2500
-2000
-1500
-1000
-500
0
500
1000
1500
2000
Inventive Dirty-Up
Inventive Clean-Up
Comparative Dirty-Up
Comparative Clean-Up
Comparative Dirty-Up
Comparative Clean-Up

FUEL COMPOSITION

TECHNICAL FIELD

The present invention relates to fuel compositions including certain fuel additives for providing enhanced engine and/or injector performance, fuel additive packages, and to methods for using said fuel compositions for improving engine performance and/or injector performance.

BACKGROUND

Fuel compositions for vehicles are continually being improved to enhance various properties of the fuels in order to accommodate their use in newer, more advanced engines including both gasoline port fuel injected engines as well as gasoline direct injected engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic or one type of engine, but at the same time be detrimental to another characteristic of the fuel. In some instances, fuel additives effective in gasoline port fuel injection engines do not necessarily provide comparable performance in gasoline direct injection engines and vice versa. In yet other circumstances, fuel additives often require an unreasonably high treat rate to achieve desired effects, which tends to place undesirable limits on the available amounts of other additives in the fuel composition. Yet other fuel additives tend to be expensive and/or difficult to manufacture or incorporate in fuels. Such shortcomings are particularly true in the context of quaternary ammonium salt fuel additives that are often difficult or costly to manufacture and/or require relatively high treat rates for performance.

SUMMARY

According to the present invention there is provided an unleaded gasoline fuel a fuel composition comprising a major amount of base fuel and a detergent additive package, wherein the detergent additive package comprises a quaternary ammonium internal salt detergent and a Mannich base detergent mixture, wherein the quaternary ammonium internal salt is obtained from amines or polyamines that is substantially devoid of any free anion species, and wherein the Mannich base detergent mixture comprises a first Mannich base detergent component derived from a di- or polyamine and a second Mannich base detergent component derived from a monoamine, wherein the weight ratio of the first Mannich base detergent to the second Mannich base detergent mixtures ranges from about 1:6 to about 3:1, and wherein the weight ratio of the quaternary ammonium internal salt detergent and the Mannich base detergent mixture ranges from about 1:10 to about 1:100.

According to the present invention there is further provided the use of an unleaded gasoline fuel composition for improving engine and/or injector performance in a gasoline direct injection engine, wherein the unleaded gasoline fuel composition comprises a major amount of gasoline base fuel and a detergent additive package, wherein the detergent additive package comprises a quaternary ammonium internal salt detergent and a Mannich base detergent mixture, wherein the quaternary ammonium internal salt is obtained from amines or polyamines that is substantially devoid of any free anion species, and wherein the Mannich base detergent mixture comprises a first Mannich base detergent component derived from a di- or polyamine and a second Mannich base detergent component derived from a monoamine, wherein the weight ratio of the first Mannich base detergent to the second Mannich base detergent mixtures ranges from about 1:6 to about 3:1, and wherein the weight ratio of the quaternary ammonium internal salt detergent and the Mannich base detergent mixture ranges from about 1:10 to about 1:100.

According to the present invention there is further provided a method for improving engine performance and/or injector performance in a gasoline direct injection engine, the method comprising supplying to the engine an unleaded gasoline fuel composition comprising a major amount of gasoline base fuel and a detergent additive package wherein the detergent additive package comprises a quaternary ammonium internal salt detergent and a Mannich base detergent mixture, wherein the quaternary ammonium internal salt is obtained from amines or polyamines that is substantially devoid of any free anion species, and wherein the Mannich base detergent mixture comprises a first Mannich base detergent component derived from a di- or polyamine and a second Mannich base detergent component derived from a monoamine, wherein the weight ratio of the first Mannich base detergent to the second Mannich base detergent mixtures ranges from about 1:6 to about 3:1, and wherein the weight ratio of the quaternary ammonium internal salt detergent and the Mannich base detergent mixture ranges from about 1:10 to about 1:100.

The method or the use of the previous paragraph may include optional steps, features, or limitations in any combination thereof. Approaches or embodiments of the method or use may include one or more of the following: wherein the improved injector performance is one of improved fuel flow, improved fuel economy, improved engine efficiency, or combinations thereof; and/or wherein the improved injector performance is measured by one of injector pulse width, injection duration, injector flow, or combinations thereof.

BRIEF DESCRIPTION OF DRAWINGS

FIG. 1 is a graph showing Long Term Fuel Trim (LTFT) of the Inventive example and Comparative examples 1 and 2.

DETAILED DESCRIPTION

The unleaded gasoline fuel composition of the present invention comprises combinations of Mannich detergents and quaternary ammonium salts and, in particular, Mannich detergents and hydrocarbyl-substituted quaternary ammonium internal salts discovered effective to provide improved engine and/or injector performance in gasoline direct injection (GDI) engines. Also provided herein are methods of using or combusting a fuel including the fuel additive combinations herein to achieve the improved engine and/or injector performance.

It has been found by the present inventors that the unleaded gasoline fuel composition of the present invention provides improved engine and/or injector performance, including controlling or reducing fuel injector deposits. Improved injector performance may also lead to one or more of improved fuel flow, improved fuel economy, and/or improved engine efficiency as determined via one or more of injector pulse width, injection duration, and/or injector flow.

In one aspect of the present invention, the unleaded gasoline fuel composition comprises a gasoline base fuel and a detergent additive package. The detergent additive package is typically used at a concentration from 6 PTB (23 ppmw) to 528 PTB (2000 ppmw), preferably from 8 PTB (30 ppmw) to 300 PTB (1125 ppmw), more preferably from 30 PTB (113 ppmw) to 250 PTB (942 ppmw) (where PTB stands for pounds of additive per thousand barrels of gasoline).

The detergent additive package for use herein comprises a Mannich base detergent mixture that comprises a quaternary ammonium internal salt detergent and a Mannich base detergent mixture, wherein the quaternary ammonium internal salt is obtained from amines or polyamines that is substantially devoid of any free anion species, and wherein the Mannich base detergent mixture comprises a first Mannich base detergent component derived from a di- or polyamine and a second Mannich base detergent component derived from a monoamine, wherein the weight ratio of the first Mannich base detergent to the second Mannich base detergent mixtures ranges from about 1:6 to about 3:1, preferably about 1:4 to about 2:1, more preferably about 1:2 to about 2:1, e.g., 1:1, and wherein the weight ratio of the quaternary ammonium internal salt detergent and the Mannich base detergent mixture ranges from about 1:10 to about 1:100, preferably about 1:20 to about 1:50, more preferably about 1:25 to about 1:35, e.g., about 1:25, about 1:30, or about 1:35. Suitable Mannich base detergent mixtures for use herein are disclosed in US2016/0289584. The package may also contain a solvent. Examples of the suitable solvent include aromatic solvents (e.g., xylene, aromatic 100, aromatic 150, and aromatic 200), paraffinic solvent, alcohol, petroleum distillates (e.g., gasoline), ester, or a mixture thereof. The package may further comprise one or more of a demulsifier, a corrosion inhibitor, an antiwear additive, an antioxidant, a metal deactivator, an antistatic additive, a dehazer, an antiknock additive, a lubricity additive, and/or a combustion improver. In one aspect, the quaternary ammonium internal salt detergent and the Mannich base detergent mixture together constitutes 5-90% of the package.

In one embodiment herein, a suitable fuel additive package comprises (i) a Mannich base detergent mixture comprising (a) a first Mannich base detergent component derived from a di- or polyamine, (b) a second Mannich base detergent component derived from a monoamine, (ii) a quaternary ammonium internal salt. and (iii) optionally, a carrier fluid component selected from the group consisting of a polyether monool and polyether polyol. The ratio weight of the first Mannich base detergent to the second Mannich base detergent in the fuel additive package ranges from about 1:6 to about 3:1, such as from about 1:4 to about 2:1, or from about 1:3 to about 1:1. The ratio weight of the Mannich base detergent mixture and the quaternary ammonium salt in the detergent additive package ranges from about 1:10 to about 1:100, preferably about 1:20 to about 1:50, more preferably about 1:25 to about 1:35, e.g., about 1:25, about 1:30, or about 1:35.

In another aspect of the present invention, the gasoline fuel composition comprises a combination of Mannich base detergent additives and quaternary ammonium internal salt detergents instead of a detergent additive package. In this aspect of the present invention, the Mannich base detergent additives are added to the gasoline base fuel, either by premixing the individual detergent additives together, optionally together with one or more antiwear additives and/or one or more succinimde detergents and/or one or more carrier fluids, and then adding the premix to the gasoline base fuel, or by adding the individual detergent additives and the individual antiwear additives and carrier fluids, directly to the gasoline base fuel.

Mannich Base Detergents

The Mannich base detergents useful in the present invention are the reaction products of an alkyl-substituted hydroxy aromatic compound, an aldehyde and an amine. The alkyl-substituted hydroxyaromatic compound, aldehyde and amine used in making the Mannich detergent reaction products described herein may be any such compounds known and applied in the art, provided the Mannich based detergents include at least a first Mannich base detergent derived from a di- or polyamine and at least a second Mannich base detergent derived from a dialkyl monoamine.

Representative alkyl-substituted hydroxyaromatic compounds that may be used in forming the Mannich base reaction products are polypropylphenol/cresol (formed by alkylating a phenol/cresol with polypropylene), polybutylphenol or polybutylphenol (formed by alkylating a phenol/cresol with polybutenes and/or polyisobutylene) and polybutyl-co-polypropylphenol/cresol (formed by alkylating phenol/cresol with a copolymer of butylene and/or butylene and propylene). Other similar long-chain alkylphenols may also be used. Examples include phenols/cresols alkylated with copolymers of butylene and/or isobutylene and/or propylene, and one or more mono-olefinic co-monomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene, butylenes and/or isobutylene may be aliphatic and may also contain non-aliphatic groups, e.g., styrene, o-methylstyrene, p-methylstyrene, di-vinyl benzene and the like. Thus in any case the resulting polymers and copolymers used in forming the alkyl-substituted hydroxyaromatic compounds are substantially aliphatic hydrocarbon polymers. In one embodiment herein, polybutylphenol or polybutylcresol (formed by alkylating a phenol/cresol with polybutylene) is used in forming the Mannich base detergents. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol/cresol reactant.

The alkylation of the hydroxyaromatic compound is typically performed in the presence of an alkylating catalyst at a temperature in the range of about 50° to about 200° C. Acidic catalysts are generally used to promote Friedel-Crafts alkylation. Typical catalysts used in commercial production include sulfuric acid, BF3, aluminum phenoxide, methanesulphonic acid, cationic exchange resin, acidic clays and modified zeolites.

The long chain alkyl substituents on the benzene ring of the phenolic compound are derived from polyolefin having a number average molecular weight (MW) of from about 500 to about 3000 Daltons (preferably from about 500 to about 2100 Daltons) as determined by gel permeation chromatography (GPC). It is also desirable that the polyolefin used have a polydispersity (weight average molecular weight/number average molecular weight) in the range of about 1 to about 4 (suitably from about 1 to about 2) as determined by GPC.

The Mannich detergents may be made from a long chain alkylphenol or a long chain alkylcresol. However, other phenolic compounds may be used including high molecular weight alkyl-substituted derivatives of resorcinol, hydroquinone, catechol, hydroxydiphenyl, benzylphenol, phenethylphenol, naphthol, tolylnaphthol, among others. Particularly suitable for the preparation of the Mannich condensation products are the polyalkylphenol and polyalkylcresol reactants, e.g., polypropylphenol, polybutylphenol, polypropylcresol, polyisobutylcresol, and polybutylcresol, wherein the alkyl group has a number average molecular weight of about 500 to about 2100, while the most suitable alkyl group is a polybutyl group derived from polybutylene having a number average molecular weight in the range of about 800 to about 1300 Daltons.

The configuration of the alkyl-substituted hydroxyaromatic compound is that of a para-substituted monoalkylphenol or a para-substituted mono-alkyl ortho-cresol. However, any alkylphenol readily reactive in the Mannich condensation reaction may be used. Thus, Mannich products made from alkylphenols having only one ring alkyl substituent, or two or more ring alkyl substituents are suitable for use in making the Mannich base detergents described herein. The long chain alkyl substituents may contain some residual unsaturation, but in general, are substantially saturated alkyl groups. Long chain alkyl phenols, according to the disclosure, include cresol. Representative reactants include, but are not limited to, linear, branched or cyclic alkylene monoamines and di- or polyamines having at least one suitably reactive primary or secondary amino group in the molecule. Other substituents such as hydroxyl, cyano, amido, etc., may be present in the amine compound. In one embodiment, the first Mannich base detergent is derived from an alkylene di- or polyamine Such di- or polyamines may include, but are not limited to, polyethylene polyamines, such as ethylenediamine, diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine and mixtures of such amines having nitrogen contents corresponding to alkylene polyamines of the formula $H_2N$-(A-NH—)$_n$ H, where A is divalent ethylene and n is an integer of from 1 to 10. The alkylene polyamines may be obtained by the reaction of ammonia and dihaloalkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbon atoms are suitable alkylene polyamine reactants.

In one embodiment, the first Mannich base detergent is derived from an aliphatic linear, branched or cyclic diamine or polyamine having one primary or secondary amino group and one tertiary amino group in the molecule. Examples of suitable polyamines include N,N,N",N"-tetraalkyl-dialkylenetriamines (two terminal tertiary amino groups and one central secondary amino group), N,N,N",N"-tetraalkyltrialkylenetetramines (one terminal tertiary amino group, two internal tertiary amino groups and one terminal primary amino group), N,N,N,N",N"-pentaalkyltrialkylene-tetramines (one terminal tertiary amino group, two internal tertiary amino groups and one terminal secondary amino group), N,N-dihydroxyalkyl-alpha, omega-alkylenediamines (one terminal tertiary amino group and one terminal primary amino group), N,N,N'-trihydroxy-alkylalpha, omega-alkylenediamines (one terminal tertiary amino group and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which suitably contain from 1 to 4 carbon atoms each. In one embodiment, the alkyl groups of the polyamine are methyl and/or ethyl groups. Accordingly, the polyamine reactants may be selected from N,N-dialkylalpha, omega-alkylenediamine, such as those having from 3 to about 6 carbon atoms in the alkylene group and from 1 to about 12 carbon atoms in each of the alkyl groups. A particularly useful polyamine is N,N-dimethyl-1-,3-propanediamine and N-methyl piperazine.

Examples of polyamines having one reactive primary or secondary amino group that can participate in the Mannich condensation reaction and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)-1-methyl-1,2-ethanediamine, N-(tert-butyl)-1-methyl-1,3-propanediamine, and 3,5-di(tert-butyl)aminoethyl-1-piperazine.

The second Mannich base detergent may be derived from an alkyl-monoamine, that includes, without limitation, a di-alkyl monoamine such as methylamine, dimethyl amine, ethylamine, di-ethylamine, propylamine, isopropylamine, dipropyl amine, di-isopropyl amine, butylamine, isobutylamine, di-butyl amine, di-isobutylamine, pentylamine, dipentyl amine, neopentylamine, di-neopentyl amine, hexylamine, dihexyl amine, heptylamine, diheptyl amine, octylamine, dioctyl amine, 2-ethylhexylamine, di-2-ethylhexyl amine, nonylamine, dinonyl amine, decylamine, didecyl amine, dicyclohexylamine, and the like.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. A particularly suitable aldehyde may be selected from formaldehyde and formalin.

The condensation reaction among the alkylphenol, the specified amine(s) and the aldehyde may be conducted at a temperature in the range of about 40° C. to about 200° C. The reaction may be conducted in bulk (no diluent or solvent) or in a solvent or diluent. Water is evolved and may be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively.

Suitable Mannich base detergents for use in the disclosed embodiments include those detergents taught in U.S. Pat. Nos. 4,231,759, 5,514,190, 5,634,951, 5,697,988, 5,876,468, 6,800,103 and 10,457,884 the disclosures of which are incorporated herein by reference.

When formulating the fuel compositions used herein, a mixture of the Mannich base detergents is used. The mixture of Mannich base detergents includes a weight ratio of from about 1:6 to about 3:1 of the first Mannich base detergent to the second Mannich base detergent. In another embodiment, the mixture of Mannich base detergents includes a weight ratio of from about 1:4 to about 2:1, such as from about 1:3 to about 1:1, of the first Mannich base detergent to the second Mannich base detergent. The total amount of Mannich base detergent in a gasoline fuel composition according to the disclosure may range from about 10 to about 400 parts per million by weight based on a total weight of the fuel composition.

An optional component of the fuel compositions and/or additive package(s) described herein is a succinimide detergent. The succinimide detergent suitable for use in various embodiments of the disclosure may impart a dispersant effect on the fuel composition when added in an amount effective for that purpose. The presence of the succinimide, together with the mixed Mannich base detergents, in the fuel composition is observed to result in enhanced deposit formation control, relative to the performance of the succinimide together with either the first or second Mannich base detergent.

The succinimide detergents, for example, include alkenyl succinimides comprising the reaction products obtained by reacting an alkenyl succinic anhydride acid, acid-ester or lower alkyl ester with an amine containing at least one primary amine group.

Suitable succinimide base detergents for use herein include those disclosed in US2016/0289584, incorporated by reference herein.

When the succinimide detergent is present in the fuel compositions/additive packages herein, the weight ratio of succinimide detergent to Mannich base detergent mixture preferably ranges from about 0.04:1 to about 0.2:1.

In another embodiment, the Mannich base detergent mixture and the succinimide detergent may be used with a liquid carrier or induction aid. Such carriers may be of various types, such as for example liquid poly-alphaolefin oligomers, mineral oils, liquid poly(oxyalkylene) compounds, liquid alcohols or polyols, polyalkenes, liquid esters, and similar liquid carriers. Mixtures of two or more such carriers may be used. Suitable carrier fluids for use herein include those disclosed in US2016/0289584, incorporated herein by reference.

When the carrier fluid is present, the weight ratio of carrier fluid to Mannich base detergent mixture preferably ranges from about 0.25:1 to about 1:1.

The fuel compositions and/or detergent additive packages herein may also comprise an anti-wear component which may be selected from a hydrocarbyl amide and a hydrocarbyl imide.

In one embodiment, the hydrocarbyl amide is an alkanol amide derived from diethanol amine and oleic acid. In another embodiment, the hydrocarbyl imide is a succinimide derived from polyisobutenyl succinic anhydride and ammonia. In one embodiment, the hydrocarbyl amide compound may be one or more fatty acid alkanol amide compounds.

Suitable anti-wear additives for use herein include those disclosed in US2016/0289584, incorporated herein by reference.

Quaternary Ammonium Internal Salt

The detergent additive package or fuel compositions herein include a quaternary ammonium salt and, preferably, a quaternary ammonium internal salt or betaine compound. As used herein, the term 'internal salt' means a molecule that contains an equal number of positively- and negatively-charged functional groups. The term 'internal salt' can be used interchangeably with the term 'zwiterrion'. As used herein, the term betaine is a zwitterion that cannot isomerize to an all-neutral form, such as when the positive change is located on a quaternary ammonium group. The quaternary ammonium salt additive may be any hydrocarbyl substituted quaternary ammonium internal salt (or betaine) obtained from amines or polyamines that are substantially devoid of any free anion species. For example, such additive may be made by reacting a tertiary amine of the structure below

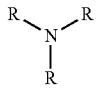

wherein each R group of the above structure is independently selected from hydrocarbyl groups containing from 1 to 200 carbon atoms with a halogen substituted C2-C8 carboxylic acid, ester, amide, or salt thereof. In approaches, what is generally to be avoided is quaternizing agents selected from the group consisting of hydrocarbyl substituted carboxylates, carbonates, cyclic-carbonates, phenates, epoxides, or mixtures thereof. In one embodiment, the halogen substituted C2-C8 carboxylic acid, ester, amide, or salt thereof may be selected from chloro-, bromo-, fluoro-, and iodo-C2-C8 carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium or potassium salt of a chloroacetic acid.

As used herein the term "substantially devoid of free anion species" means that the anions, for the most part are covalently bound to the product such that the reaction product as made does not contain substantial amounts of free anions or anions that are ionically bound to the product. In one embodiment, "substantially devoid" means a range from 0 to less than about 2 weight percent of free anion species, less than about 1.5 weight percent, less than about 1 weight percent, less than about 0.5 weight percent, or none.

In another embodiment, a tertiary amine including monoamines and polyamines may be reacted with the halogen substituted acetic acid, ester, or other derivative thereof to provide the quaternary ammonium internal salt additive herein. Suitable tertiary amine compounds are those of structure above wherein each of R group is independently selected, as noted above, from hydrocarbyl groups containing from 1 to 200 carbon atoms. Each hydrocarbyl group R may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Any of the foregoing hydrocarbyl groups may also contain hetero atoms, such as oxygen or nitrogen atoms. Particularly suitable hydrocarbyl groups may be linear or branched alkyl groups. In some embodiments, the tertiary amine may be the reaction product of a diamine or triamine with one tertiary amine and a hydrocarbyl substituted carboxylic acid. In other embodiments, some representative examples of amine reactants which can be reacted to yield compounds of this disclosure include, but are not limited to, trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N,N-dimethylpropane diamine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexa-methylenetetramine, N,N,N',N'-tetramethylethylenediamine, N,N,N',N'-tetramethyl-propylenediamine, N,N,N',N'-tetraethyl-1,3-propanediamine, methyldi-cyclohexyl amine, 2,6-dimethylpyridine, dimethylcylohexylamine, C10-C30-alkyl or alkenyl-substituted amidopropyldimethylamine, C12-C200-alkyl or alkenyl-substituted succinic-carbonyl-dimethylamine, and the like. In embodiment, a suitable quaternary ammonium internal salt additive may be the internal salts of oleyl amidopropyl dimethylamino or oleyl dimethyl amine.

If the amine contains solely primary or secondary amino groups, it may be necessary to alkylate at least one of the primary or secondary amino groups to a tertiary amino group prior to the reaction with the halogen substituted C2-C8 carboxylic acid, ester, amide, or salt thereof. In one embodiment, alkylation of primary amines and secondary amines or mixtures with tertiary amines may be exhaustively or partially alkylated to a tertiary amine. It may also be necessary to properly account for the hydrogens on the nitrogen and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted C2-C8 carboxylic acid, ester, amide, or salt thereof for use in making the quaternary internal salt additive may be derived from a mono-, di-, or tri- chloro-, bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable halogen substituted carboxylic acid, ester, or salt thereof may be selected from chloroacetic acid or esters thereof and sodium or potassium chloroacetate. The amount of halogen substituted C2-C8 carboxylic acid, ester, amide, or salt thereof relative to the amount of tertiary amine reactant may range from a molar ratio of about 1:0.1 to about 0.1:1.0.

In yet other embodiments, internal salts of the mixtures herein may be made according to the foregoing procedures and may include, but are not limited to (1) hydrocarbyl substituted compounds of the formula R"—$NMe_2CH_2COO$ where R" is from C1 to C30 or a substituted amido group; (2) fatty amide substituted internal salts; and (3) hydrocarbyl substituted imide, amide, or ester internal salts wherein the hydrocarbyl group has 8 to 40 carbon atoms. Particularly suitable internal salts may be selected from the group consisting of polyisobutenyl substituted succinimide, succinic diamide, and succinic diester internal salts; C8-C40 alkenyl substituted succinimide, succinic diamide, and succinic diester internal salts; oleyl amidopropyl dimethylamino internal salts; and oleyl dimethylamino internal salts.

In yet another embodiment, the quaternary ammonium internal salt of the fuel additives and fuels herein is an internal salt or betaine compound having the structure of Formula II below:

(Formula II)

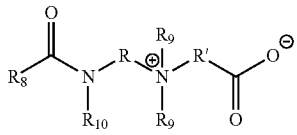

wherein R and R' of the structure above are independently alkylene linkers having 1 to 10 carbon atoms (in other approaches 1 to 3 carbon atoms); $R_8$ is a saturated alkylene, unsaturated alkene, or a linear, branched, or cyclic hydrocarbyl group or optionally a substituted or unsubstituted C12 to C100 hydrocarbyl group, or an aryl group or optionally substituted aryl group (in one approach, $R_8$ is a C8 to C20 hydrocarbyl group); each $R_9$ is independently a linear or branched C1 to C4 alkyl group; and $R_{10}$ is a hydrogen atom or a C1 to C4 alkyl group. The internal salts of Formula II may also be substantially devoid of free anion species as discussed above.

In another embodiment, the quaternary ammonium salt additive includes the compound of Formula II above wherein R is a propylene linker, R' is a methylene linker, $R_8$ is a C8 to C20 hydrocarbyl group, each $R_9$ is a methyl group, and $R_{10}$ is hydrogen. In yet other embodiments, the quaternary ammonium salt internal salt is selected from oleyl amidopropyl dimethylamine internal salts or oleyl dimethylamino internal salts. In some embodiments, such additive may be substantially devoid of free anion species as noted above.

An exemplary reaction scheme of preparing the quaternary ammonium internal salt is shown below in the exemplary process of Reaction Scheme I; of course, other methods of preparing the first quaternary ammonium salt additives described herein may also be utilized:

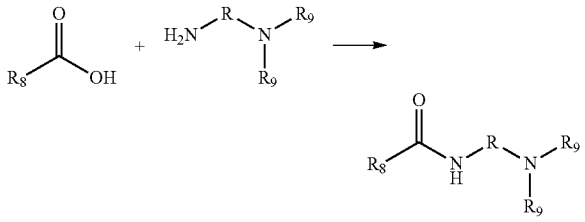

-continued

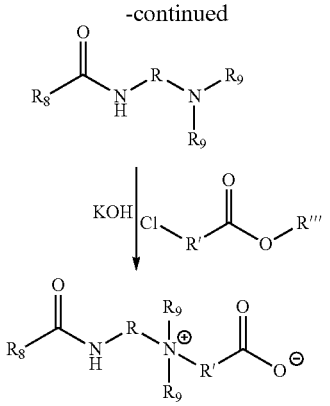

In the reaction scheme above, $R_8$ may be as described above or, in one approach, an alkyl group such as a C12 to C100 hydrocarbyl group; R and R' are independently alkylene linkers having 1 to 10 carbon atoms; each $R_9$ is independently a alkyl group or a linear or branched $C_1$ to $C_4$ group; and R''' is an alkyl group or hydrogen.

A fuel additive package herein may include about 1 to about 15 weight percent of the quaternary ammonium internal salt, about 1 to about 10 weight percent of the quaternary ammonium internal salt, or about 1.5 to about 5 weight percent of the quaternary ammonium internal salt (based on the total active weight of the quaternary ammonium salt in the fuel additive). When blended into a gasoline fuel, the fuel composition may include about 0.1 ppmw to about 10 ppmw of the active quaternary ammonium internal salt, about 0.3 ppmw to about 5 ppmw, or about 1 ppmw to about 3 ppmw of the active quaternary ammonium internal salt, by weight of the fuel composition.

Fuels

The fuel compositions herein comprising a major amount of base fuel. As used herein the term 'major amount' in relation to the base fuel preferably means a level of greater than 50% v/v, more preferably greater than 60% v/v, even more preferably greater than 70% v/v, especially greater than 80% v/v. In a preferred embodiment herein, 'a major amount' of base fuel means greater than 90% v/v, more preferably greater than 95% v/v, even more preferably greater than 98% v/v, based on the total fuel composition. If the liquid fuel compositions of the present invention contain a gasoline base fuel, the liquid fuel composition is a gasoline fuel composition. The gasoline may be any gasoline suitable for use in an internal combustion engine of the spark-ignition (gasoline) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight.

Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives, in addition to the essential Mannich and quaternary ammonium detergents mentioned above. The concentration and nature of the optional fuel additive(s) that may be included in the base gasoline or the gasoline composition used in the present invention is not critical. Non-limiting examples of suitable types of fuel additives that can be included in the base gasoline or the gasoline composition used in the present invention include anti-oxidants, corrosion inhibitors, antiwear additives or surface modifiers, flame speed additives, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein. The specifications the base fuel in the Examples is shown below in Table 1.

TABLE 1

Fuel Specifications.

| PROPERTY | UNITS | BASE FUEL |
|---|---|---|
| API Gravity | — | 55.5 |
| Specific Gravity | — | 0.7567 |
| Density | g/mL | 0.7559 |
| Bromine No. | — | 15 |
| BTU Gross | btu/lb | 19558 |
| BTU Net | btu/lb | 18326 |
| Unwashed Gum (ASTM D-381) | mg/100 mL | 7 |
| Washed Gum (ASTM D381) | mg/100 mL | 2 |
| Oxidation Stability (ASTM D-525) | minutes | 960+ |
| RVP (ASTM D-5191) | psi | 7.61 |
| Carbon | wt % | 86.5 |
| Hydrogen | wt % | 13.5 |
| Aromatics | vol % | 34.6 |
| Olefins | vol % | 6.2 |
| Saturates | vol % | 59.2 |
| Ethanol | vol % | 0 |
| Oxygen Content | wt % | 0 |
| Sulfur | ppm | 4.5 |
| RON | — | 91.4 |
| MON | — | 82.9 |
| Octane (R + M)/2 | — | 87.2 |
| | Distillation (ASTM D-86) | |
| Initial Boiling Point | ° F. | 92.9 |
| 5% | ° F. | 114.6 |
| 10% | ° F. | 131.4 |
| 20% | ° F. | 155.2 |
| 30% | ° F. | 178.6 |
| 40% | ° F. | 204.3 |
| 50% | ° F. | 227.8 |
| 60% | ° F. | 247.5 |
| 70% | ° F. | 268 |
| 80% | ° F. | 291.4 |
| 90% | ° F. | 321.8 |
| 95% | ° F. | 349.5 |
| End Point | ° F. | 411.3 |
| Recovery | % | 96.6 |
| Residue | % | 1.1 |
| Loss | % | 2.3 |

Example 1

An oleylamidopropyl dimethylammonium betaine quaternary ammonium internal salt can be made by the process described in U.S. Pat. No. 8,894,726 (Inventive Example 3), which is incorporated herein by reference.

Example 2

The two Mannich detergents and the quaternary ammonium salt were blended into the base fuel described in Table 1 at the treat rates set forth in Table 2 below. The First Mannich Detergent was prepared from a high reactivity polyisobutylene cresol, a diamine, and formaldehyde according to a known method (see, e.g., U.S. Pat. No. 6,800,103, which is incorporated herein by reference). The Second Mannich Detergent was prepared using the same method but with a monoamine. The quaternary ammonium internal salt was oleylamidopropyl dimethylammonium from Example 1.

TABLE 2

| | Comparative Example 1 | | Comparative Example 2 | | Inventive Example | |
|---|---|---|---|---|---|---|
| Ingredients | ppmw | PTB | ppmw | PTB | ppmw | PTB |
| First Mannich Detergent | 50 | 13.2 | 0 | 0 | 50 | 13.2 |
| Second Mannich Detergent | 50 | 13.2 | 0 | 0 | 50 | 13.2 |
| Quaternary Ammonium Internal Salt | 0 | 0 | 3 | 0.8 | 3 | 0.8 |
| Mannich detergent to Quaternary ammonium salt weight ratio | — | | — | | 33:1 | |

A series of three dirty-up/clean-up (DU/CU) tests were run to evaluate the impact that fuels from Table 2 have on fuel injector deposits in a vehicle equipped with a gasoline direct injection engine (GDI). All tests were run with the base fuel from Table 1 during the Dirty-up (DU) and Clean-up (CU) phases of the respective test. The fuels were tested to evaluate the ability of each class of additive, Mannich Detergent mixture and quaternary ammonium salt, to improve injector performance by reducing injector deposits in the GDI engine both individually (Comparative Example 1 and Comparative Example 2) and together (Inventive Example).

The base fuel had previously been evaluated in a bench engine to determine its propensity to foul, or dirty-up, injectors. The level of fouling could be measured indirectly using Engine Control Management (ECM) algorithm parameters such as changes in injector pulse width or long-term fuel trim (LTFT). The test bed for this evaluation was a gasoline direct injection GM LHU engine pursuant to the RIFT methods as set forth in Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated by reference herein.

In order to accelerate the DU phase of the Base Fuel, a combination of di-tert-butyl disulfide (DTBDS 406.1 ppmw) and tert-butyl hydrogen peroxide (TBHP, 286 ppmw) were added to the base fuel to provide the fouling in the range of 5-12% within the time allotted to the DU phase. Percent of fouling in the GM engine based on injector pulse width is calculated as:

$$\text{Percent of fouling} := \frac{\text{Injector pulse width} - \text{injector pulse width at start of testing}}{\text{injector pulse at start of testing}} * 100\%$$

A series of three GDI CU deposit tests were conducted to demonstrate the removal of deposits that had been formed in the fuel injectors during the dirty-up (DU) phase. The base fuel in Table 1, treated with DTBDS and TBHP, was used for DU. This vehicle-based test procedure used a 2008 Pontiac Solstice vehicle mounted to a chassis dynamometer. This procedure was first set forth in DuMont, R., et. al., "Test and Control of Fuel Injector Deposits in Direct Injected Spark Ignition Vehicles," SAE Technical Paper 2009-01-2641, 2009, doi:10.4271/2009-01-2641. It consists of a 48-hour DU cycle with continuous monitoring of LTFT to maintain stoichiometric Air/Fuel ratio. After the DU cycle was completed, the fuel was changed to one of the additized formulations described in Table 2 and then operated for a 48-hour CU cycle. The percentage of LTFT increase during the DU cycle, and subsequent decrease during the CU cycle, is one parameter for evaluating the fouling or cleaning effect of the fuel candidate at the treat rates set forth in Table 3 below, which demonstrated a clean-up (CU) of 62% within 48 hours for the inventive example. CU is calculated as in the following equation:

$$CU\% = \frac{-(LTFT \text{ at end of } CU - LTFT \text{ at end of } DU) \times 100\%}{(LTFT \text{ at end of } DU - LTFT \text{ in the beginning of } DU)}$$

TABLE 3

| | Comparative Example 1 | Comparative Example 2 | Inventive Example |
|---|---|---|---|
| First Mannich Detergent, PTB | 13.2 | 0 | 13.2 |
| Second Mannich Detergent, PTB | 13.2 | 0 | 13.2 |
| Quaternary ammonium salt, PTB | 0 | 0.8 | 0.8 |
| GDI CU by RIFT method, % LTFT | | | |
| Steady state 55 mph | 6.2 | 28.1 | 62.0 |

As shown in Table 3 above, the inventive example exhibited improved injector clean-up relative to the comparative examples. With the combination of the first and second Mannich detergents and the quaternary ammonium salt, the CU % was 62% while the two Mannich detergents alone provided 6.2% GDI CU and the quaternary ammonium salt 28.1%. FIG. 1 is a graphical representation of the data in Table 3. FIG. 1 shows Long Term Fuel Trim (LTFT) of the Inventive example and Comparative examples 1 and 2

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A gasoline fuel additive package comprising:

(i) a quaternary ammonium internal salt detergent and (ii) a Mannich base detergent mixture, wherein the quaternary ammonium internal salt is obtained from amines or polyamines that is substantially devoid of any free anion species, wherein the Mannich base detergent mixture comprises (a) a first Mannich base detergent component derived from a di- or polyamine and (b) a second Mannich base detergent component derived from a monoamine, wherein the weight ratio of the first Mannich base detergent to the second Mannich base detergent mixture ranges from about 1:6 to about 3:1, wherein the weight ratio of the quaternary ammonium internal salt detergent and the Mannich base detergent mixture ranges from about 1:25 to about 1:35.

2. The gasoline fuel additive package according to claim 1, wherein the weight ratio of the first Mannich base detergent to the second Mannich base detergent ranges from about 1:1 to about 1:3.

3. The gasoline fuel additive package according to claim 1, wherein the first Mannich base detergent and the second Mannich base detergent are derived from polyisobutenyl-substituted hydroxyaromatic and wherein the polyisobutenyl group has a molecular weight ranging from 500 to 1000 Daltons, as determined by gel permeation chromatography.

4. The gasoline fuel additive package according to claim 3, wherein the polyisobutenyl-substituted hydroxyaromatic is polyisobutenyl-substituted phenol or cresol.

5. The gasoline fuel additive package according to claim 4, wherein the polyisobutenyl-substituted hydroxyaromatic is polyisobutenyl-substituted cresol.

6. The gasoline fuel additive package according to claim 1, wherein the quaternary ammonium internal salt has the structure of Formula II (Formula II)

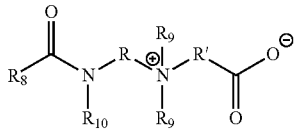

wherein R and R' are, independently, alkylene linkers having 1 to 10 carbon atoms; $R_8$ is a C12 to C100 alkylene, alkene, or hydrocarbyl group or an aryl group or optionally substituted aryl group; each $R_9$ is, independently, a linear or branched C1 to C4 alkyl group; and $R_{10}$ is a hydrogen atom or a C1 to C4 alkyl group.

7. The gasoline fuel additive package according to claim 5, wherein the quaternary ammonium internal salt has the structure of Formula II (Formula II)

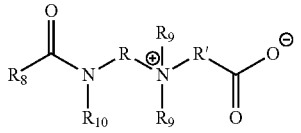

wherein R and R' are, independently, alkylene linkers having 1 to 10 carbon atoms; $R_8$ is a C12 to C100 alkylene, alkene, or hydrocarbyl group or an aryl group or optionally substituted aryl group; each $R_9$ is, independently, a linear or branched C1 to C4 alkyl group; and $R_{10}$ is a hydrogen atom or a C1 to C4 alkyl group.

8. The gasoline fuel additive package according to claim 1, wherein the package further comprises a solvent, and the quaternary ammonium internal salt detergent (i) and the Mannich base detergent mixture (ii) constitutes 5-90% by weight of the package.

9. The gasoline fuel additive package according to claim 7, wherein the package further comprises a solvent, and the quaternary ammonium internal salt detergent (i) and the Mannich base detergent mixture (ii) constitutes 5-90% by weight of the package.

10. The gasoline fuel additive package according to claim 1, wherein the package further comprises one or more of a demulsifier, a corrosion inhibitor, an antiwear additive, an antioxidant, a metal deactivator, an antistatic additive, a dehazer, an antiknock additive, a lubricity additive, and a combustion improver.

11. The gasoline fuel additive package according to claim 7, wherein the package further comprises one or more of a demulsifier, a corrosion inhibitor, an antiwear additive, an antioxidant, a metal deactivator, an antistatic additive, a dehazer, an antiknock additive, a lubricity additive, and a combustion improver.

12. The gasoline fuel additive package according to claim 11, wherein the package further comprises a solvent, and the quaternary ammonium internal salt detergent (i) and the Mannich base detergent mixture (ii) constitutes 5-90% by weight of the package.

13. The gasoline fuel additive package according to claim 1, wherein the first Mannich base detergent component (a) is derived from N,N-dimethyl-1,3-propanediamine and the second Mannich base detergent component (b) is derived from dialkyl monoamine.

14. The gasoline fuel additive package according to claim 1, wherein the package further comprises a polyether monool or polyether polyol carrier fluid.

15. The gasoline fuel additive package according to claim 7, wherein the package further comprises a polyether monool or polyether polyol carrier fluid.

16. The gasoline fuel additive package according to claim 11, wherein the package further comprises a polyether monool or polyether polyol carrier fluid.

17. The gasoline fuel additive package according to claim 1, wherein the weight ratio of the quaternary ammonium internal salt detergent and the Mannich base detergent mixture ranges from about 1:30 to about 1:35.

* * * * *